US009938925B2

(12) United States Patent
Morgan et al.

(10) Patent No.: US 9,938,925 B2
(45) Date of Patent: Apr. 10, 2018

(54) CYLINDER LINER WITH CHAMFER AND ANTI-POLISHING CUFF

(71) Applicant: Caterpillar Inc., Peoria, IL (US)

(72) Inventors: Brad Morgan, Chillicothe, IL (US); Shu Zhang, Dunlap, IL (US); Thomas R. McClure, Washington, IL (US); Michael R. Bochart, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 24 days.

(21) Appl. No.: 15/155,737

(22) Filed: May 16, 2016

(65) Prior Publication Data

US 2017/0328298 A1 Nov. 16, 2017

(51) Int. Cl.

| | |
|---|---|
| ***F02F 1/00*** | (2006.01) |
| *B22D 19/00* | (2006.01) |
| *F02F 1/18* | (2006.01) |
| *F02F 1/16* | (2006.01) |

(52) U.S. Cl.

CPC ..... *F02F 1/004* (2013.01); *B22D 19/0009* (2013.01); *F02F 1/16* (2013.01); *F02F 1/18* (2013.01); *F02F 2001/006* (2013.01)

(58) Field of Classification Search

CPC ..... F02F 1/004; F02F 2001/006; F02F 1/18; F02F 1/16; B22D 19/0009

USPC ..... 123/193.2

See application file for complete search history.

(56) References Cited

U.S. PATENT DOCUMENTS

| | | | | |
|---|---|---|---|---|
| 3,489,130 | A | 1/1970 | Polidan et al. | |
| 4,770,133 | A * | 9/1988 | Schibalsky | F02F 3/00 123/193.2 |
| 6,234,134 | B1 | 5/2001 | Bedapudi et al. | |
| 7,438,039 | B2 | 10/2008 | Poola et al. | |
| 7,677,217 | B2 | 3/2010 | Kumar et al. | |
| 8,459,175 | B2 | 6/2013 | Blythe et al. | |
| 8,601,995 | B2 | 12/2013 | Worthington et al. | |
| 2012/0304954 | A1 | 12/2012 | Kiser et al. | |
| 2016/0097340 | A1 | 4/2016 | Morgan et al. | |

FOREIGN PATENT DOCUMENTS

| | | | |
|---|---|---|---|
| DE | 102011012507 | B4 | 11/2014 |
| KR | 1020050006324 | A | 1/2005 |
| WO | WO 2015/082235 | A1 | 6/2015 |

* cited by examiner

*Primary Examiner* — Jacob Amick
*Assistant Examiner* — Charles Brauch

(57) ABSTRACT

A cylinder liner assembly for inclusion in the cylinder bore of an internal combustion engine includes a sleeve-like cylinder liner and an anti-polishing ring to scrape combustion deposits from a piston reciprocally movable along an axis line of the cylinder liner. A fire dam may axially protrude from a first liner end of the cylinder liner and may have an obliquely angled chamfer disposed therein circumscribing the axis line. To locate the anti-polishing ring proximate to the top land of the piston when at the top dead center position, the anti-polishing ring can include a cuff header disposed at the first cuff end that is generally triangular and has an angled undercut corresponding to the obliquely angled chamfer. When mated, the chamfer and angled undercut abut against each other.

13 Claims, 3 Drawing Sheets

CYLINDER LINER WITH CHAMFER AND ANTI-POLISHING CUFF

TECHNICAL FIELD

This patent disclosure relates generally to an internal combustion engine and, more particularly, to an anti-polishing cuff used to remove hard carbon deposits and similar buildup that forms on the upper land or rim of a piston reciprocally disposed in the engine.

BACKGROUND

Internal combustion engines are widely used to combust hydrocarbon based fuels such as diesel or gasoline and convert the potential chemical energy of the fuel into rotational or mechanical power than can be utilized for other work. A typical internal combustion engine includes an engine block having one or more cylinder bores disposed therein, each of which can slidably receive a piston connected to a crankshaft that can reciprocally move within the cylinder bore. Combustion of fuel in the cylinder bore forces the piston from the top dead center (TDC) position at one end of the cylinder bore toward the bottom dead center (BDC) position at the opposite end during the power stroke to rotate a crankshaft while continued rotation of the crankshaft returns the piston to the TDC position. To facilitate sliding motion of the piston, a cylinder liner may be inserted into the cylinder bore that is dimensioned to fit in close tolerance with the piston. The cylinder liners may be replaceable, for example, as a disposable component that enables occasional rebuilding of the engine.

During the combustion process, hard particles from the combustion of fuel and/or lubricating oils may be deposited at the upper rim and about the top peripheral surface of the piston due to the exposure of those surfaces to combustion occurring in the combustion chamber. The hard particles may accumulate and abrasively rub against the inner surface of the cylinder liner thereby polishing or wearing away the inside of the liner. A consequence of this polishing action is that the engine may be more susceptible to blow-by of combustion gases around the piston into the crankcase and may further increase the consumption of lubricating oil directed between the piston and liner. A solution to reduce liner polishing is disclosed in German patent publication DE 10 2011 012 507 B4 ("the Volker publication"), which describes the inclusion of a sleeve-like anti-polishing cuff or ring at the top of the cylinder liner. The anti-polishing cuff, referred to as a fire ring in the Volker publication, may have an inner cuff diameter smaller than the liner and is positioned to scrape carbon and other deposits from the upper peripheral surfaces or top land of the piston as it moves to the TDC position. The Volker publication discloses the anti-polishing ring is retained at the top of the cylinder liner by complementary steps or shoulders that abut together. The present disclosure is also directed to an anti-polishing ring for use with particular styles of cylinder liners.

SUMMARY

The disclosure describes, in one aspect, a cylinder liner assembly for an internal combustion engine that includes a cylinder liner and an anti-polishing cuff. The cylinder liner has an annular liner body extending along an axis line and a fire dam axially protruding from a first liner end of the annular liner body. The fire dam terminates at an upper annular dam surface that is perpendicularly to the axis line. A chamfer is disposed in the fire dam at an oblique angle to the axis line. The anti-polishing cuff includes an annular cuff body and a cuff head disposed annularly along a first cuff end of the annular cuff body. The cuff head includes an upper annular cuff surface and an angled undercut that is configured to adjacently abut the correspondingly configured chamfer when the cylinder liner and the anti-polishing cuff are mated together.

In another aspect, the disclosure describes another cylinder liner assembly including a cylinder liner and an anti-polishing cuff. The cylinder liner includes an annular liner body extending along an axis line between a first liner end and a second liner end. The annular liner body further delineates an inner liner cylindrical surface having a substantially consistent inner liner diameter. To protect the cylinder head gasket, the cylinder liner further includes a fire dam axially protruding from the first liner end that circumscribing the axis line. The fire dam has a chamfer disposed therein at an oblique angle with respect to the axis line. The anti-polishing cuff similarly has an annular cuff body extending between a first cuff end and a second cuff end. The thickness of the annular cuff body is generally consistent between the first cuff end and second cuff end. The anti-polishing cuff further includes a cuff head that is enlarged with respect to the annular cuff body. The cuff head has an angled undercut at an oblique angle with respect to the axis line that can complementary abut against the chamfer.

In yet another aspect, the disclosure describes an anti-polishing cuff for installation in a cylinder liner assembly to scrape combustion deposits from a piston. The anti-polishing cuff includes an annular cuff body extending between a first cuff end and a second cuff end along an axis line and that delineates an inner cuff diameter and an outer cuff diameter. The thickness of the annular cuff body between the inner and outer diameters is generally consistent. The anti-polishing further includes a cuff head extending annular about the first cuff end. The cuff head has an angled undercut arranged at an oblique angle with respect to the axis line and that is directed at least partly radially outward with respect to the outer cuff diameter.

DETAILED DESCRIPTION

Figure 1:
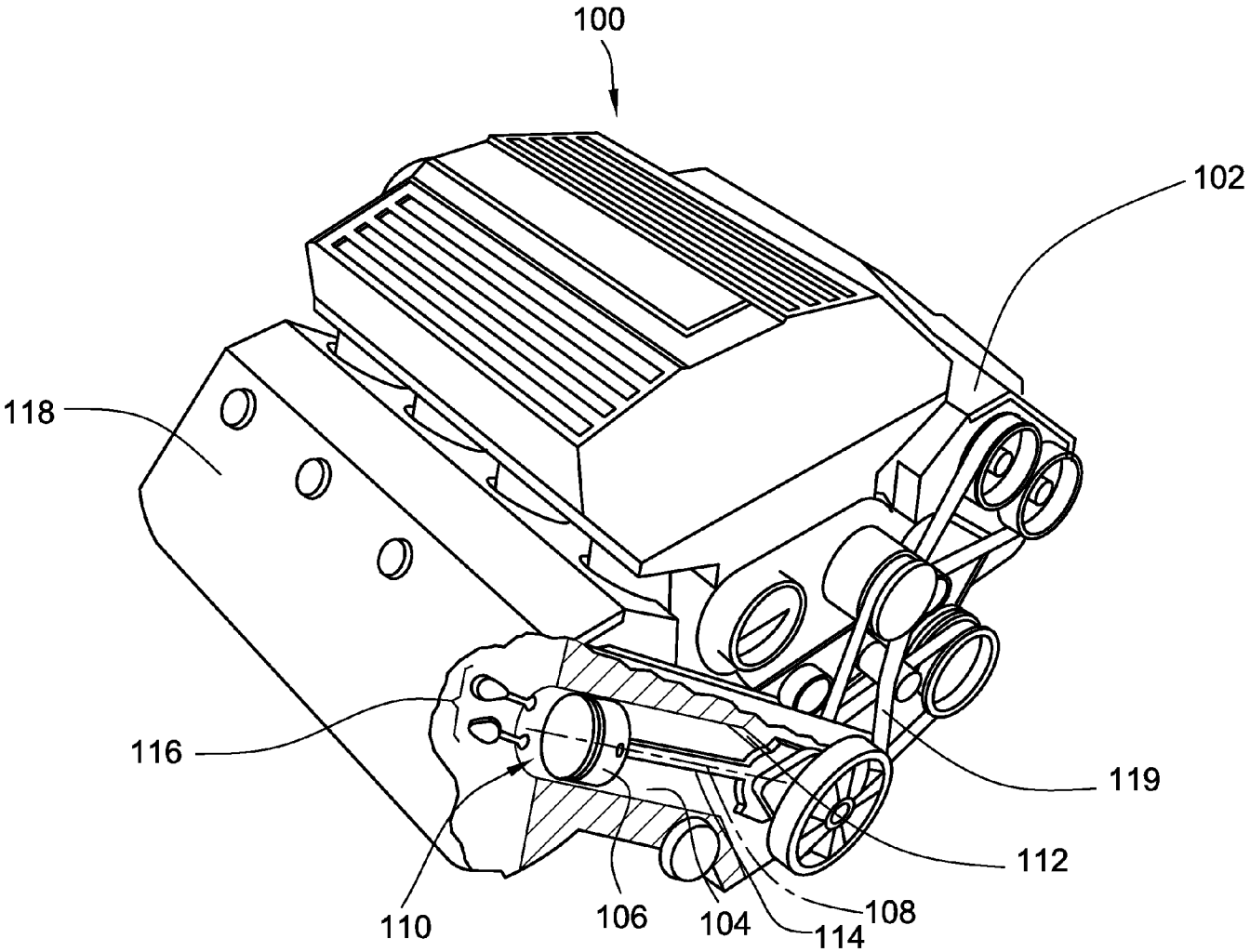
FIG. 1 is a perspective, partial cutaway view of an internal combustion engine showing a piston reciprocally movable within a cylinder bore and designed in accordance with the present disclosure.

Now referring to the drawings, wherein like reference numbers refer to like elements, there is illustrated in FIG. 1 an internal combustion engine 100 such as, for example, a diesel-burning compression ignition engine or a gasoline-burning, spark-ignition for converting hydrocarbon based fuels into mechanical power for powering a machine. As used herein, the term "machine" may refer to any machine that performs some type of operation associated with an industry such as mining, construction, farming, transportation, or any other industry known in the art. For example, the machine may be an earth-moving machine, such as a wheel loader, excavator, dump truck, backhoe, motor grader, material handler or the like. In other embodiments, the machine may be a stationary machine such as a pump or compressor for inducing fluid flow, or a generator for generating off-gird electrical power. Moreover, an implement may be connected to the machine. Such implements may be utilized for a variety of tasks, including, for example, loading, compacting, lifting, brushing, and include, for example, buckets, compactors, forked lifting devices, brushes, grapples, cutters, shears, blades, breakers/hammers, augers, and others.

The internal combustion engine 100 includes an engine block 102 made of any suitable material such as, for example, steel or cast iron. One or more cylinder bores 104 can be disposed in the engine block 102, each of which can accommodate a complementarily sized piston 106 that is reciprocally movable along a longitudinal axis line 108 delineated by the bore. The cylinder bore 104 and movable piston 106 thereby define a variable volume or combustion chamber 110. The pistons 106 in turn are pivotally connected to a rotating crankshaft 112 by an elongated connecting rod 114 in a manner that enables the piston to reciprocally move between a top dead center (TDC) position and a bottom dead center (BDC) position within the cylinder bore 104. Accordingly, the piston 106 can axially move in strokes along the axis line 108 to complete the steps of a four-stroke combustion cycle including the intake, compression, combustion, and exhaust strokes. To further facilitate the four-stroke cycle, the internal combustion engine 100 can include additional components such as intake and exhaust valves 116 associated with the combustion chamber 110, intake and exhaust gas manifolds 118, timing belts or chains 119, and any other known engine component. In the illustrated embodiment, the internal combustion engine 100 may be a V-configuration engine in which the cylinder bores and associated pistons are aligned in a V-formation; however, the disclosure contemplates other arrangements such as an in-line configuration, an opposing-piston configuration, a radial-configuration or any other suitable configuration. Further, while applicable to any particular size of internal combustion engine, the disclosure particularly contemplates large bored, high horse-powered (>300 Hp) engine in which the diameters of the bore and piston may be dimensioned about 100 mm or greater. Likewise, while a four-stroke cycle is described herein, the disclosure may be applicable to a two-stroke cycle.

Figure 2:
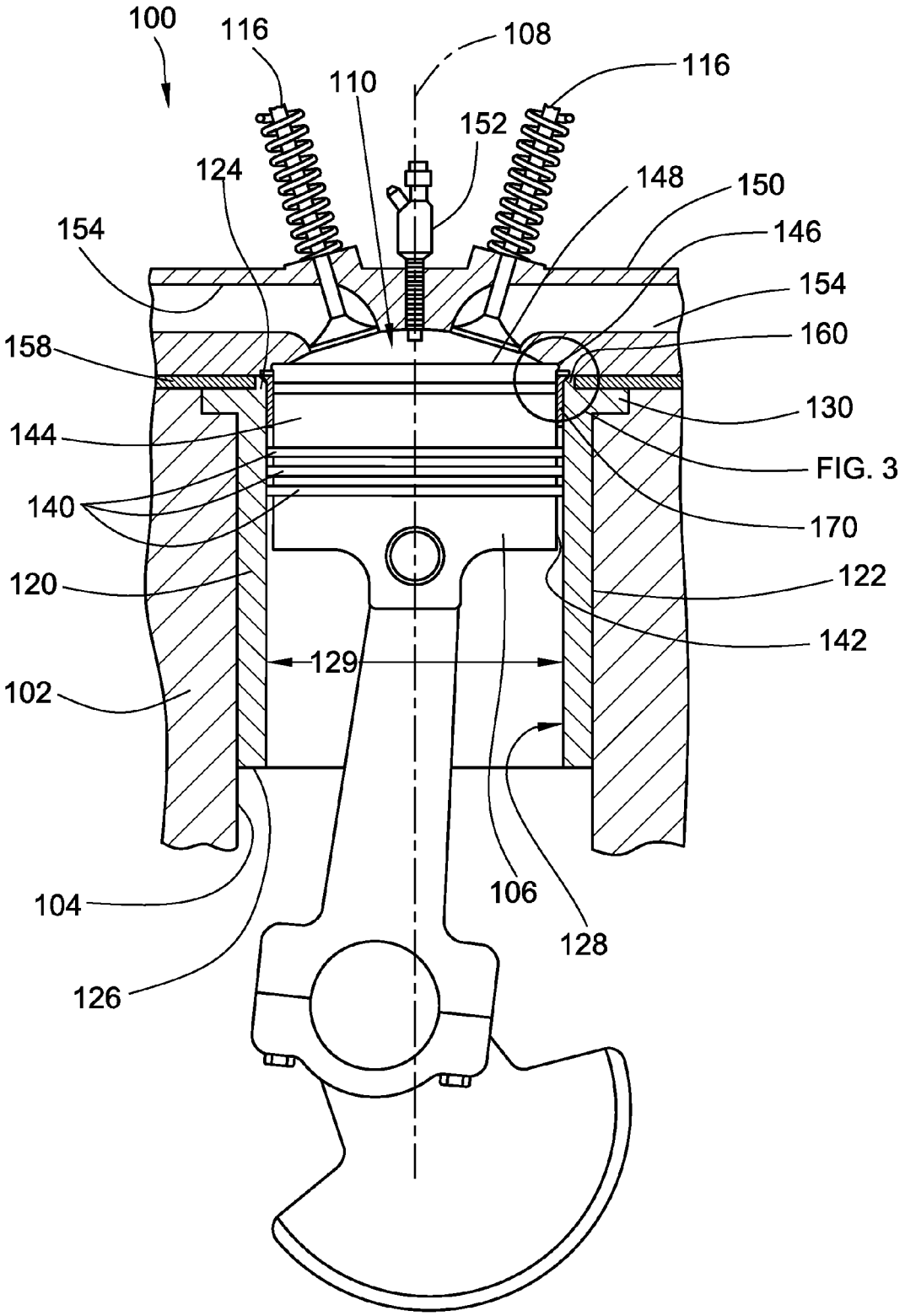
FIG. 2 is a schematic, cross-sectional view of a cylinder bore fitted with a cylinder liner and a piston reciprocally disposed therein at the top dead center position to engage an anti-polishing cuff.

Referring to FIG. 2, to facilitate reciprocal motion of the piston 106 along the axis line 108, there is illustrated a particular design for an internal combustion engine 100 in which a cylinder liner 120 is fixedly fitted within the cylinder bore 104 and provides a sleeve-like structure within which the piston moves. The cylinder liner 120 can have a hollow, tubular or annular liner body 122 that extends along the length of the cylinder bore 104 between a first liner end 124 and a second liner end 126. Moreover, the height of the cylinder liner 120 between the first and second liner ends 124, 126 can be at least coextensive with the stroke length of the piston 106. The annular liner body 122 further has an inner liner cylindrical surface 128 that circumferentially extends around the axis line 108 and that may have a substantially consistent inner liner diameter 129 between the first and second liner ends 124, 126. Because of the consistent inner liner diameter 129, the inner liner cylindrical surface 128 is parallel to the axis line 108. The inner liner diameter 129 defined by the inner liner cylindrical surface 128 can be slightly larger than the diameter of the piston 106 to allow for free reciprocal motion of the piston within the cylinder bore 104. To further facilitate relative motion between the piston 106 and the stationary cylinder liner 120, the inner liner cylindrical surface 128 may have a patterned or honed finish for the accommodation or distribution of lubricating oil between the piston and liner.

To secure the cylinder liner 120 in the cylinder bore 104 of the engine block 102, the external walls of the annular liner body 122 can include retention features disposed thereon. For example, the cylinder liner 120 can have a flange 130 disposed at the first liner end 124 that extends radially outward with respect to the annular liner body 122 and hence the axis line 108 when the cylinder liner is installed in the cylinder bore 104. The flange 130 can be accommodated in a complementary feature disposed into the upper surface of the engine block 102 so that the first liner end 124 is generally coextensive with the TDC position of the piston 106 and the annular liner body 122 is concentric about the axis line 108. Further, the flange 130 enables the annular liner body 122 to descend downward into the cylinder bore 104 when installed. As described in more detail below, the flange 130 can include an uppermost sealing surface 132 arranged normal or perpendicular to the axis line 108 and that generally extends radially outward with respect to the axis line. In an embodiment, the cylinder liner 120 can be removable from the engine block 102 and replaceable to enable rebuilding the internal combustion engine 100. The cylinder liner 120 can be made of any suitable material including, for example, extruded or deep-drawn steel.

To make sliding contact with the cylinder liner 120, the piston 106 can be equipped with a plurality of piston rings 140. The piston rings 140 can have an outer ring diameter of a slightly larger dimension than the piston diameter measured at the circular peripheral sidewall 142 of the cylindrical piston. Further, the outer diameter of the piston rings 140 may be equal to the inner liner diameter 129 delineated by the inner liner cylindrical surface 128 of the cylinder liner 120. Thus, the piston rings 140 seal the combustion chamber 110 from below and prevent exhaust gases from blowing by the piston 106 into the crankcase. The piston rings 140 can be accommodated in complementary grooves circumferentially disposed into and axially spaced along the peripheral sidewall 142 so the rings are radially concentric to the axis line 108 and move with the piston 106. The grooves separate the cylindrical peripheral sidewall 142 into a plurality of lands extending circumferentially around the piston 106 including a top land 144 disposed above the uppermost piston ring that forms the piston rim 146 with the axially oriented piston head 148. In various embodiments, the piston 106 can include a bowl or other features disposed into the piston head 148 to distribute intake air and fuel mixture and to improve the effect of the combustion event in the combustion chamber 110.

To enclose the combustion chamber 110, the internal combustion engine 100 can include a cylinder head 150 mounted to the engine block 102 and disposed axially above the cylinder bores 104. Like the engine block 102, the cylinder head 150 can be made from steel or cast iron. Additionally, the cylinder head 150 can mountably accommodate a fuel injector 152 for the introduction of fuel and the intake and exhaust valves 116 that direct intake air into and exhaust gasses out of the combustion chamber 110. Various passages 154 can be disposed through the cylinder head 150 to channel the gasses appropriately. To seal the combustion chamber 110, a cylinder head gasket 158 can be disposed at the interface between the engine block 102 and the cylinder head 150 and which includes apertures corresponding to the cylinder bores 104. The cylinder head gasket 158 can prevent oil or coolant from entering the combustion chamber 110 and assist in maintaining compression in the chamber as the piston 106 moves to the TDC position. The cylinder head gasket 158 can be made from any suitable sealing material commonly utilized with internal combustion engines such as layered steel sheets or carbon composites.

Figure 3:
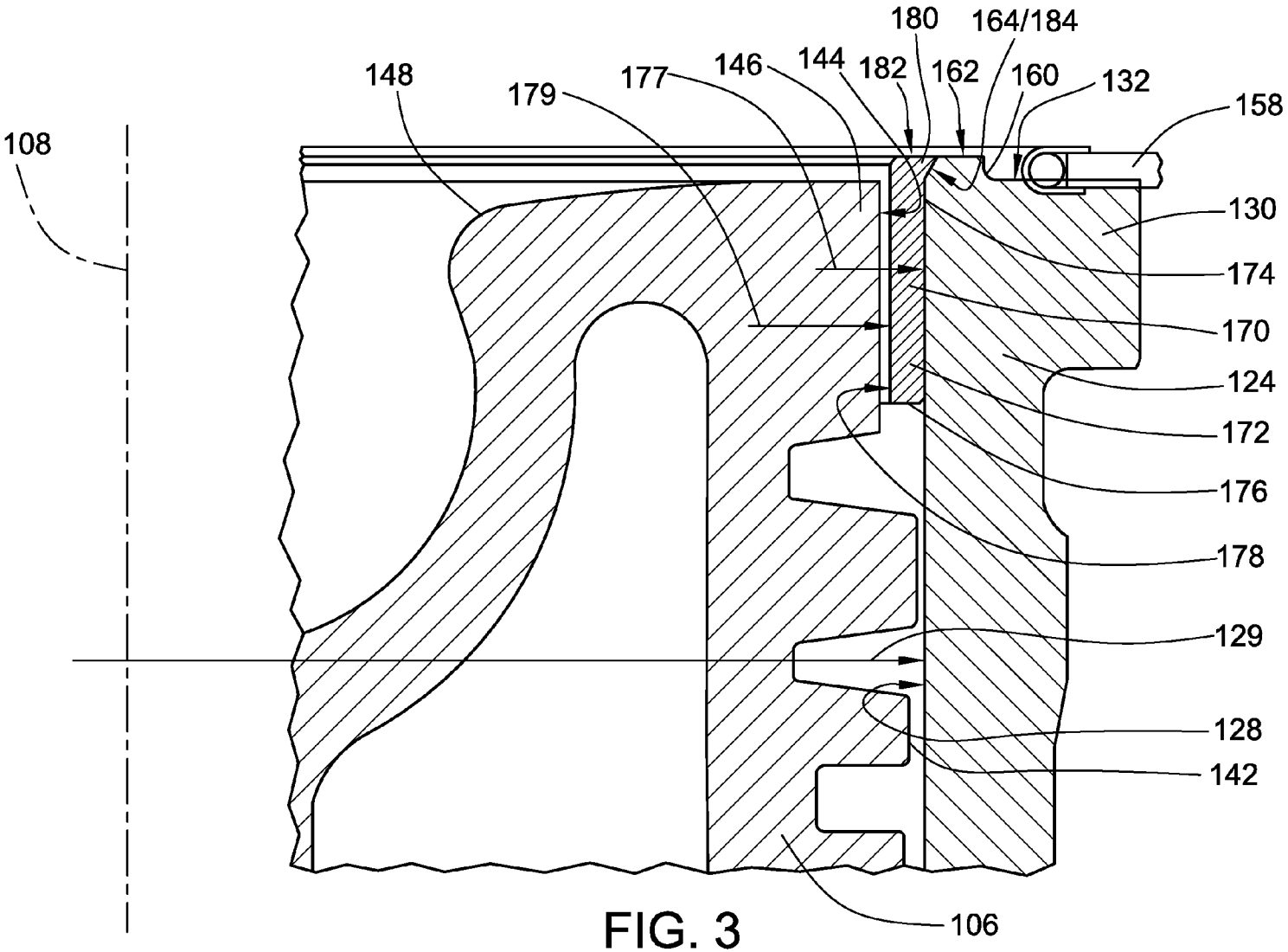
FIG. 3 is a detailed view of the area indicated in FIG. 2 showing the anti-polishing cuff retained to the cylinder liner by abutting engagement of an angled undercut with a chamfer disposed on the fire dam of the liner.

Referring to FIGS. 2 and 3, to reduce exposure of the cylinder head gasket 158 to combustion inside the combustion chamber 110, the cylinder liner 120 can include a fire dam 160 at the first liner end 124 proximate to where the annular liner body 122 and the flange 130 are joined. The fire dam 160 is a raised, annular protrusion integrally joined to and projecting axially upward from the annular liner body 122 and located adjacent to the inner liner cylindrical surface 128. Hence, the annular fire dam 160 encircles the cylinder bore 104 and concentrically circumscribes the axis line 108. Further, the fire dam 160 axially extends above or over the sealing surface 132 on the flange 130 and terminates in an upper annular dam surface 162. By way of example only, if the annular liner body 122 has an axially length between the first liner end 124 and the second liner end 126 of about 300 mm, the fire dam 160 can have a height measured between the sealing surface 132 of the flange 130 and the upper annular dam surface 162 of about 2 mm. The fire dam 160 can be further configured so the upper annular dam surface 162 is disposed above the piston head 148 when the piston 106 is in the TDC position. When the cylinder head is mounted to the engine block 102, the upper annular dam surface 162 can abut against the underside of the cylinder head. Thus, the fire dam 160 separates the sealing surface 130 and cylinder head gasket 158 from the combustion chamber 110 and protects the gasket during the combustion stroke.

To assist in assembling the internal combustion engine 100, specifically by facilitating insertion of the piston 106 and the piston rings 140 into the cylinder bore 104 as described below, the fire dam 160 can include a bevel or chamfer 164 formed along the radial inner corner where the upper annular dam surface 162 of the fire dam joins the inner liner cylindrical surface 128 of the annular liner body 122. The chamfer 164 is arranged at a non-parallel or oblique angle with respect to the axis line 108, for example, 30°-45° off of parallel with the axis line though greater or smaller oblique angles are contemplated, and circumscribes the cylinder bore 104 and axis line 108. The chamfer 164 can be directed at least partly radially outward from the inner liner cylindrical surface 128 to provide a frustoconical surface extending around the radial inner corner of the inner liner cylindrical surface. The axial height of the chamfer 164 may be approximate to the height of the fire dam 160 between the sealing surface 132 and the upper annular dam surface 162 so the chamfer is generally inclusively demarcated within the structure of the fire dam, though in other embodiments, the axial height of the chamfer may be less or greater than the height of the fire dam. For example, in an embodiment, the axial height of the chamfer 164 may be about 80% to about 120% of the axial height of the fire dam 160.

In an embodiment of the cylinder liner 120, the chamfer 164 can be an insertion chamfer that is pre-formed or fabricated into the fire dam 160 during manufacture of the cylinder liner. In this embodiment, the insertion chamfer 164 is configured to assist aligning and centering the piston 106 and the piston rings 140 with respect to the cylinder bore 104 and to the axis line 108 during the engine building process. In the embodiments where the cylinder liner 120 is produced by extrusion or a deep drawing process, the chamfer 164 can be formed into the fire dam 160 by a forging or cold working process.

As indicated above, because the top land 144 and the piston rim 146 are directly exposed to the combustion process in the combustion chamber 110, an anti-polishing cuff 170 can be installed in the cylinder bore 104 to remove carbon deposits from those surfaces. The anti-polishing cuff 170 can be positioned at the first liner end 124 of the annular liner body 122 so that the top land 144 passes adjacent to the anti-polishing cuff when the piston 106 moves to the TDC position. The anti-polishing cuff 170 can be generally similar in shape to, but smaller than, the cylinder liner 120 and can include a sleeve-like, tubular or annular cuff body 172 extending between a first cuff end 174 and a second cuff end 176. The annular cuff body 172 is a hollow cylindrical structure with an outer cuff diameter 177 substantially equal to the inner liner diameter 129 of the inner liner cylindrical surface 128. The annular cuff body 172 further includes an inner cuff cylindrical surface 178 having an inner cuff diameter 179 that is smaller than the inner liner diameter 129 so that the inner cuff cylindrical surface is dimensioned to receive and closely fit around the top land 144 of the piston 106. Hence, the second cuff end 176 can scrape away combustion deposits or particles gathering about the top land 144.

To ensure the deposits and particles are removed, the annular cuff body 172 can have a cuff height between the first cuff end 174 and the second cuff end 176 substantially similar to the height of the top land 144 of the piston 106. Hence, the anti-polishing cuff 170 and the top land 144 are adjacent to and coextensive with each other when the piston 106 is at the TDC position while the second cuff end 176 remains positioned above the piston rings 140. As shown in the illustrated embodiment, the outer cuff diameter 177 has a generally consistent dimension over the length to the anti-polishing cuff 170 and the inner cuff cylindrical surface 178 defines a consistent inner cuff diameter 179 over the same cuff height. Accordingly, the annular cuff body 172 has a consistent cuff thickness as measured between the outer and inner cuff diameters 177, 179 between the first and second cuff ends 174, 176.

To locate and retain the anti-polishing cuff 170 where it can scrape particles from the piston 106 at the TDC position, the anti-polishing cuff can include a cuff head 180 formed at the first cuff end 174 that engages with the chamfer 164 on the cylinder liner 120. The cuff head 180 extends circumferentially along the first cuff end 174 and is enlarged with respect to the cuff thickness of the rest of the annular cuff body 172. In particular, the profile of the cuff head 180 viewed in cross-section through the anti-polishing cuff 170 has a generally triangular shape delineated by the upper portion of the inner cuff cylindrical surface 178, an upper annular cuff surface 182 that is wider than the thickness of the annular cuff body 172, and an angled undercut 184 descending from the upper cuff surface. The inner cuff cylindrical surface 178 and the upper annular cuff surface 182 can orthogonally intersect each other thereby providing the right angled legs of a right angled triangle. Similarly, the angled undercut is arranged at an oblique angle with respect to both the inner cuff cylindrical surface 178 and the upper annular cuff surface 182 to complete the triangular shape of the cuff head 180. The angled undercut 184 further causes the annular upper cuff surface 182 to project radially outward with respect to the outer cuff diameter 177 of the annular cuff body 172.

Moreover, the oblique angle of the angled undercut 184 can correspond to the oblique angle of the chamfer 164 on the cylinder liner 120. Accordingly, when the anti-polishing cuff 170 is mated to the cylinder liner 120, the cuff head 180 is accommodated and sits within the space created by the chamfer 164 and the angled undercut 184 abuts against the chamfer. The interaction between the chamfer 164 and the angled undercut 184 concentrically centers the anti-polishing cuff 170 with respect to the axis line 108 while vertically supporting the cuff in the cylinder bore 104. This also positions the annular cuff body 172 of the anti-polishing cuff 170 between the inner liner cylindrical surface 128 and the top land 144 of the piston 106. Further, the chamfer 164 and the angled undercut 184 can be designed so the upper annular cuff surface 182 sits flush with or just below the upper annular dam surface 162 of the fire dam 160 so the anti-polishing cuff does not interfere with the sealing between the engine block and the cylinder head.

By way of example, in a specific embodiment, the cuff height of the anti-polishing cuff 170 between the lower second end 176 and the upper annular cuff surface 182 is about 15 millimeters that, as indicated above, may correspond to the height of the top land 144 on the piston 106. The height of the cuff head 180 separate from the annular cuff body 172 can be less than a 100% of the overall height of the anti-polishing cuff 170, for example, about 5% to 10% of the overall height of the anti-polishing cuff 170. In a further embodiment, the anti-polishing cuff 170 can be made from the same steel material as the cylinder liner 120 so the components have similar thermal expansion characteristics. The anti-polishing cuff can be made by extruding or drawing steal then cold-forming the cuff head.

INDUSTRIAL APPLICABILITY

The disclosure provides an advantageous way of installing an anti-polishing cuff in an internal combustion engine in a manner that preserves the structural integrity of the engine. In particular, referring to FIG. 3, a sleeve-like cylinder liner 120 can be installed in the cylinder bore 104 of an engine block 102. The cylinder liner 120 may include an annular fire dam 160 at the uppermost first liner end 124 of the liner to protect the cylinder head gasket 158. The fire dam 160 can include a pre-formed insertion chamfer 164 obliquely disposed on the inside cylindrical corner where the upper annular dam surface 164 intersects the inner liner cylindrical surface 128. During the engine building process, when the piston 106 is being inserted into the cylinder bore, the chamfer 164 may interact with and align the piston with respect to the inner liner cylindrical surface 128 and the axis line 108.

To correctly locate and position the anti-polishing cuff 170 at the upper first liner end 124, the anti-polishing cuff can be formed with a ring-like annular cuff body 172 of generally consistent thickness but having an enlarged cuff head 180 disposed at the axial first cuff end 174 of the body. The cuff head 180 may have a triangular shape produced between an inner cuff cylindrical surface 178, an upper annular cuff surface 182, and an obliquely angled undercut 184 that generally corresponds to the chamfer 164 in the fire dam 160. After the piston 106 is inserted into the bore defined by the cylinder liner 120, the anti-polishing cuff 170 can be installed on the cylinder liner proximate to the location of the top land 144 of the piston when moved to the TDC position. In particular, the triangular cuff head 180 can be matingly received in the space created by the chamfer 164 such that the annular cuff body 172 is aligned in the space between the inner liner cylindrical surface 128 and the top land 144 on the piston. Likewise, the chamfer 164 and the angled undercut 184 are commensurately positioned and aligned to contiguously or adjacently abut each other and support the annular cuff body within the spacing between the piston 106 and cylinder liner 120.

An advantage of the disclosed structural assembly is that utilizing the pre-formed insertion chamfer 164 disposed in the fire dam 160 to align and secure the anti-polishing cuff avoids additional preparation and machining of the cylinder liner 120 compared to prior solutions. This enables the cylinder liner 120 to be made of a thinner construction and the internal combustion engine to be lighter in weight. Related results include improved power density associated with the internal combustion engine or an improved engine-power-to-weight ratio, meaning that more compact engines can be utilized for performing significant tasks. Eliminating secondary processing of the cylinder liner 120 also facilitates rebuilding or reconstruction of the internal combustion engine by enabling use of pre-formed liners in the field. These and other advantages should be apparent to those of skill in the art from the foregoing disclosure and accompanying drawings.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. Terms such as "above," "below," "top," "bottom," "first," "second," are for referential purposes with respect to the drawings only and are not intended as a limitation on the claims.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A cylinder liner assembly comprising:

a cylinder liner having an annular liner body extending along an axis line and a fire dam axially protruding from a first liner end of the annular liner body, the fire dam including an upper annular dam surface perpendicularly arranged with respect to the axis line and a chamfer disposed therein at an oblique angle to the axis line; and an anti-polishing cuff including an annular cuff body and a cuff head disposed annularly along a first cuff end of the annular cuff body, the cuff head including an upper annular cuff surface and an angled undercut configured to adjacently abut the chamfer when the cylinder liner and the anti-polishing cuff are mated, wherein the upper annular cuff surface is flush with or below the upper annular dam surface when the cylinder liner and the anti-polishing cuff are mated.

2. The cylinder liner of claim 1, wherein the annular cuff body extends between the first cuff end and a second cuff thereby delineating a cuff length, and the angled undercut has an axial height that is 100% or less of the cuff length.

3. The cylinder liner assembly of claim 2, wherein the annular cuff body includes an inner cuff cylindrical surface disposed about the axis line and the upper annular cuff surface orthogonally intersects the inner cuff cylindrical surface.

4. The cylinder liner assembly of claim 3, wherein the annular cuff body has an inner cuff diameter and outer cuff diameter and a generally consistent thickness inner cuff diameter and the outer cuff diameter.

5. The cylinder liner assembly of claim 1, wherein the chamfer is an insertion chamfer that is pre-formed in the fire dam and configured for inserting a piston into the cylinder liner during engine assembly.

6. The cylinder liner assembly of claim 1, wherein the cylinder liner includes a flange arranged generally normal to the axis line, the flange including a sealing surface for receiving a cylinder head gasket.

7. The cylinder liner assembly of claim 6, wherein the fire dam axially protrudes above the sealing surface.

8. The cylinder liner assembly of claim 1, wherein an axial height of the chamfer is between about 80% to about 120% of the axial height of the fire dam.

9. The cylinder liner assembly of claim 1, wherein the annular liner body has an inner liner cylindrical surface disposed about the axis line, the inner liner cylindrical surface having an inner liner diameter of generally consistent dimension between a first liner end and a second liner end opposite the first liner end.

10. A cylinder liner assembly comprising:

a cylinder liner including an annular liner body extending along an axis line between a first liner and a second liner end, the annular liner body delineating an inner liner cylindrical surface having an inner liner diameter of substantially consistent dimension between the first liner end and the second liner end, the cylinder liner further including a fire dam axially protruding from the first liner end and annularly circumscribing the axis line, the fire dam having a chamfer disposed therein at an oblique angle with respect to the axis line and directed at least partly radially outward with respect to the inner liner cylindrical surface; and an anti-polishing cuff including an annular cuff body extending between a first cuff end and a second cuff end and having a generally consistent thickness between the first cuff end and second cuff end;

the anti-polishing cuff further includes a cuff head enlarged with respect to the annular cuff body and disposed annularly along the first cuff end, the cuff head having an angled undercut at an oblique angle with respect to the axis line and directed at least partly radially outward, wherein the cuff head further includes an inner cuff cylindrical surface oriented toward the axis line and an upper annular cuff surface oriented normal to the axis line, the inner cuff cylindrical surface and upper annular cuff surface intersecting at a right angle wherein the angled undercut is disposed at an oblique angle with respect to the inner cuff cylindrical surface and the upper annular cuff surface, wherein the fire dam includes an upper annular dam surface arranged normal to the axis line, and the upper annular cuff surface is flush with or below the upper annular dam surface when the cylinder liner and the anti-polishing cuff are mated.

11. The cylinder liner assembly of claim 9, wherein the chamfer is disposed where the inner liner cylindrical surface and the upper annular dam surface intersect.

12. The cylinder liner assembly of claim 11, wherein the annular cuff body has a cuff height delineated between the first cuff end and the second cuff end, and cuff head has an axial height that is 100% or less of the cuff height.

13. The cylinder liner assembly of claim 10, wherein the chamfer is an insertion chamfer pre-formed in the fire dam and configured for inserting a piston into the cylinder liner during engine assembly.

* * * * *